US006419318B1

(12) United States Patent
Albright

(10) Patent No.: US 6,419,318 B1
(45) Date of Patent: Jul. 16, 2002

(54) CHAIR HAVING AN ADJUSTABLE LUMBAR MECHANISM

(75) Inventor: Scott Albright, Nashville, TN (US)

(73) Assignee: United Chair Company, Inc., Nashville, TN (US)

( * ) Notice: Subject to any disclaimer, the term of this patent is extended or adjusted under 35 U.S.C. 154(b) by 0 days.

(21) Appl. No.: 09/547,328

(22) Filed: Apr. 11, 2000

(51) Int. Cl.[7] ..... A47C 7/46

(52) U.S. Cl. ..... 297/284.7; 297/284.4; 297/353

(58) Field of Search ..... 297/284.7, 284.4, 297/410, 353

(56) References Cited

U.S. PATENT DOCUMENTS

| | | | | | |
|---|---|---|---|---|---|
| 567,096 | A | * | 9/1896 | Harvey et al. | 297/230.14 |
| 1,228,771 | A | | 6/1917 | Hanger | |
| 1,375,868 | A | | 4/1921 | Thompson | |
| 2,756,809 | A | | 7/1956 | Endresen | |
| 2,894,565 | A | | 7/1959 | Conner | |
| 2,991,124 | A | * | 7/1961 | Schwartz | 297/284.4 |
| 3,027,194 | A | | 3/1962 | Rumptz | |
| 3,063,751 | A | | 11/1962 | Hatch | |
| 3,106,423 | A | * | 10/1963 | Schwartz | 297/284.4 |
| 3,376,064 | A | | 4/1968 | Jackson | |
| 3,463,544 | A | | 8/1969 | Froelich | |
| 4,161,337 | A | | 7/1979 | Ross et al. | |
| 4,465,317 | A | * | 8/1984 | Schwartz | 297/284.4 |
| 4,632,454 | A | * | 12/1986 | Naert | 297/284 |
| 4,730,871 | A | * | 3/1988 | Sheldon | 297/284.7 |
| 4,832,401 | A | * | 5/1989 | Brooks | 297/284.7 |
| 5,335,965 | A | | 8/1994 | Sessini | |
| 5,344,211 | A | * | 9/1994 | Adat et al. | 297/230.14 |
| 5,567,011 | A | | 10/1996 | Sessini | |
| 5,624,158 | A | | 4/1997 | Adat et al | |
| 5,630,650 | A | * | 5/1997 | Peterson et al. | 297/353 |
| 5,660,438 | A | | 8/1997 | Tedesco | |
| 5,695,245 | A | * | 12/1997 | Carlson et al. | 297/314 |
| 5,711,575 | A | * | 1/1998 | Hand et al. | 297/284.6 |
| 5,791,733 | A | | 8/1998 | van Hekken et al. | |
| 5,975,632 | A | | 11/1999 | Ginat | |
| 6,092,871 | A | * | 7/2000 | Beaulieu | 297/284.4 |
| 6,189,972 | B1 | * | 2/2001 | Chu et al. | 297/284.4 |

FOREIGN PATENT DOCUMENTS

| | | |
|---|---|---|
| FR | 557 421 | 8/1923 |
| IT | 625 806 | 9/1961 |

* cited by examiner

*Primary Examiner*—Peter M. Cuomo
*Assistant Examiner*—Joseph Edell
(74) *Attorney, Agent, or Firm*—Flynn, Thiel, Boutell & Tanis, P.C.

(57) ABSTRACT

A chair having a back support arrangement which incorporates therein a height adjustable lumbar mechanism. The lumbar mechanism includes a vertically movable slide assembly which non-positively mounts thereon a lumbar support and a handle for adjusting the vertical position thereof. A detent mechanism is provided which cooperates between the slide assembly and a rigid upright of the chair to enable the adjustment of the height of the lumbar support by the user.

20 Claims, 5 Drawing Sheets

CHAIR HAVING AN ADJUSTABLE LUMBAR MECHANISM

FIELD OF THE INVENTION

This invention relates to a chair with an adjustable lumbar mechanism, and more specifically, to an improved mechanism which incorporates therein a lumbar member for supporting the lumbar region of the back and a mechanism for adjusting the vertical height thereof.

BACKGROUND OF THE INVENTION

Typical chairs for use in an office or other environment commonly include various positional features for the comfort of the user. With respect to backrest designs of conventional chairs, lumbar arrangements have been developed to support the natural curve of the spine in order to relieve or minimize stress on the lumbar vertebrae.

One mechanism of the type described above is disclosed in U.S. Pat. No. 5,975,632, which illustrates a chair including a lumbar support incorporated into the back and positioned behind an outer foam layer thereof. The vertical location of the lumbar support is adjustable via a slidable handle disposed adjacent the lower end of the back. A resilient lever-like tongue is cantilevered from the handle and defines a detent adjacent the free end thereof, and when the handle is moved up or down by the user, the detent engages within a selected one of a plurality of recesses disposed along an elongate spine of the back which is fixed to the seat assembly of the chair. In addition, the lumbar member is positively attached via fasteners to the upper end of the handle for movement therewith. In this mechanism, the cantilevered spring force of the tongue can result in upward and downward manual actuation forces which are inconsistent or different from one another. These unbalanced actuation forces tend to make adjustment of the lumbar support by a seated occupant less desirable. Further, the fixed attachment of the lumbar member to the handle by fasteners also complicates assembly.

Accordingly, it is an object of the invention to provide a chair incorporating therein a lumbar member which is easily vertically adjustable by the user, and which provides a simplified attachment of the lumbar member to the slide assembly.

More specifically, one aspect of the invention relates to a chair having a base and a support arrangement mounted on the base which includes back and seat assemblies. The back assembly includes a rigid back support member, and a bracket interconnects the seat and back assemblies. An adjustable lumbar arrangement is associated with the back assembly and includes a lumbar support and a slide element. The lumbar support is mounted on the slide element via a non-fixed connection, and the chair covering or upholstery which is snugly engaged over the back assembly maintains the lumbar support and slide element in engagement with one another.

Further, according to another aspect of the invention, a detent mechanism is provided and cooperates between the bracket and the slide element to adjust the vertical height of the lumbar support relative to the back support member. The detent mechanism is such that the manual actuation forces required to release the detent mechanism to move the lumbar support either upwardly or downwardly are substantially equal to one another, and thus the user does not experience an inconsistency in the amount of force necessary to adjust the lumbar support in one direction versus the other.

Other objects and purposes of the invention will be apparent to persons familiar with structures of this general type upon reading the following specification and inspecting the accompanying drawings.

Figure 1:
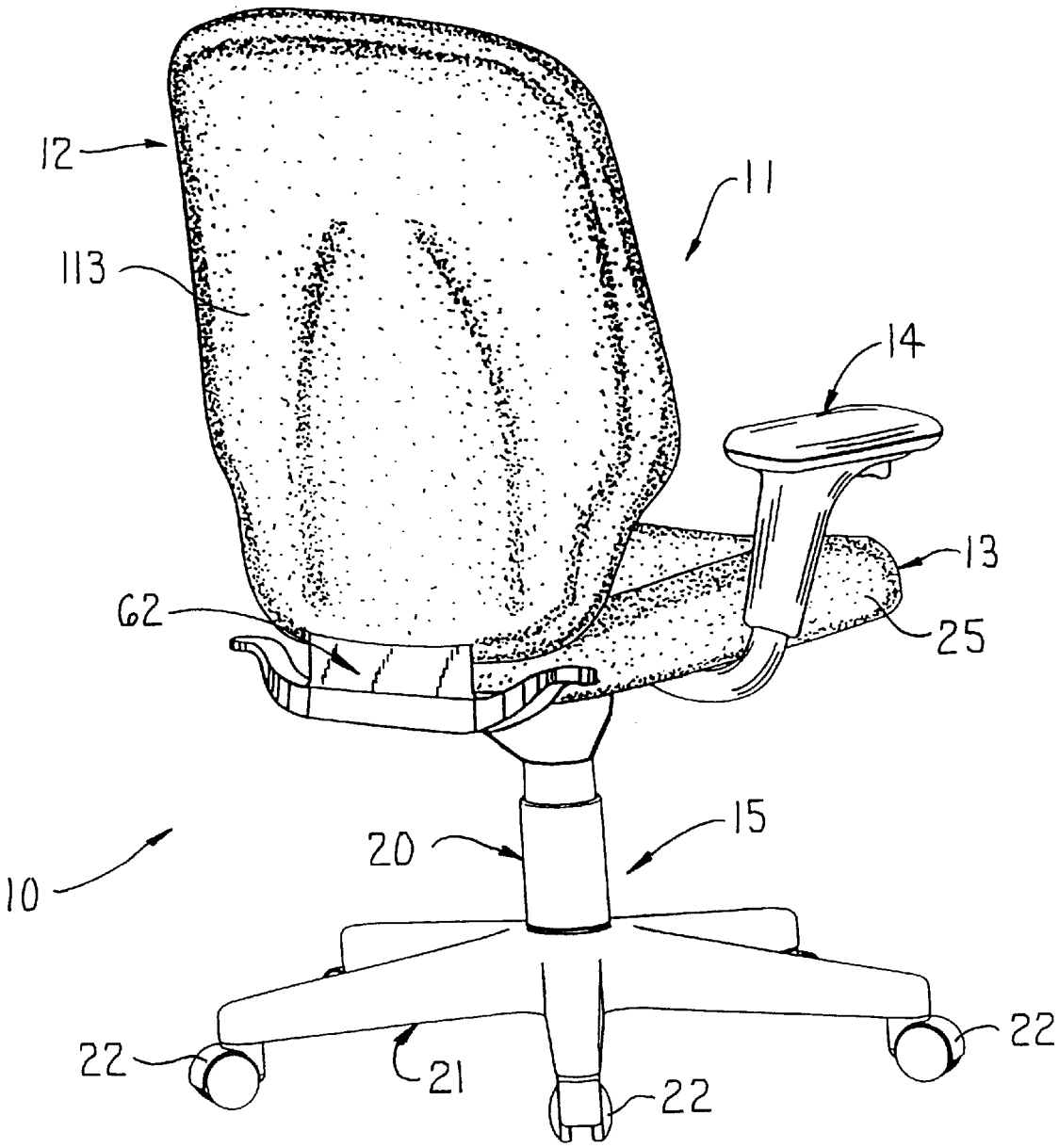
FIG. 1 is a rear elevational view in perspective of a chair having an adjustable lumbar mechanism incorporated into the backrest thereof according to the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, there is illustrated a chair 10 according to the present invention. The chair 10 includes a generally L-shaped support arrangement 11, with the basic components thereof being a back assembly 12 and a seat assembly 13. In the illustrated embodiment, a pair of arms 14 are disposed adjacent opposite sides of the chair 10 (only one of which is shown in FIG. 1), and are connected to and supported on the seat assembly 13. The support arrangement 11 is supported on a base assembly 15 which includes a height-adjustable pedestal assembly 20 which projects generally vertically upwardly and has an upper end interconnected to the seat assembly 13 substantially at the middle thereof. The pedestal assembly 20 allows height adjustment of the chair by means of a conventional chair control mechanism (not shown). The lower end of the pedestal assembly 20 is secured to a conventional multi-leg base 21, the latter typically being supported on a plurality of casters 22.

Figure 3:
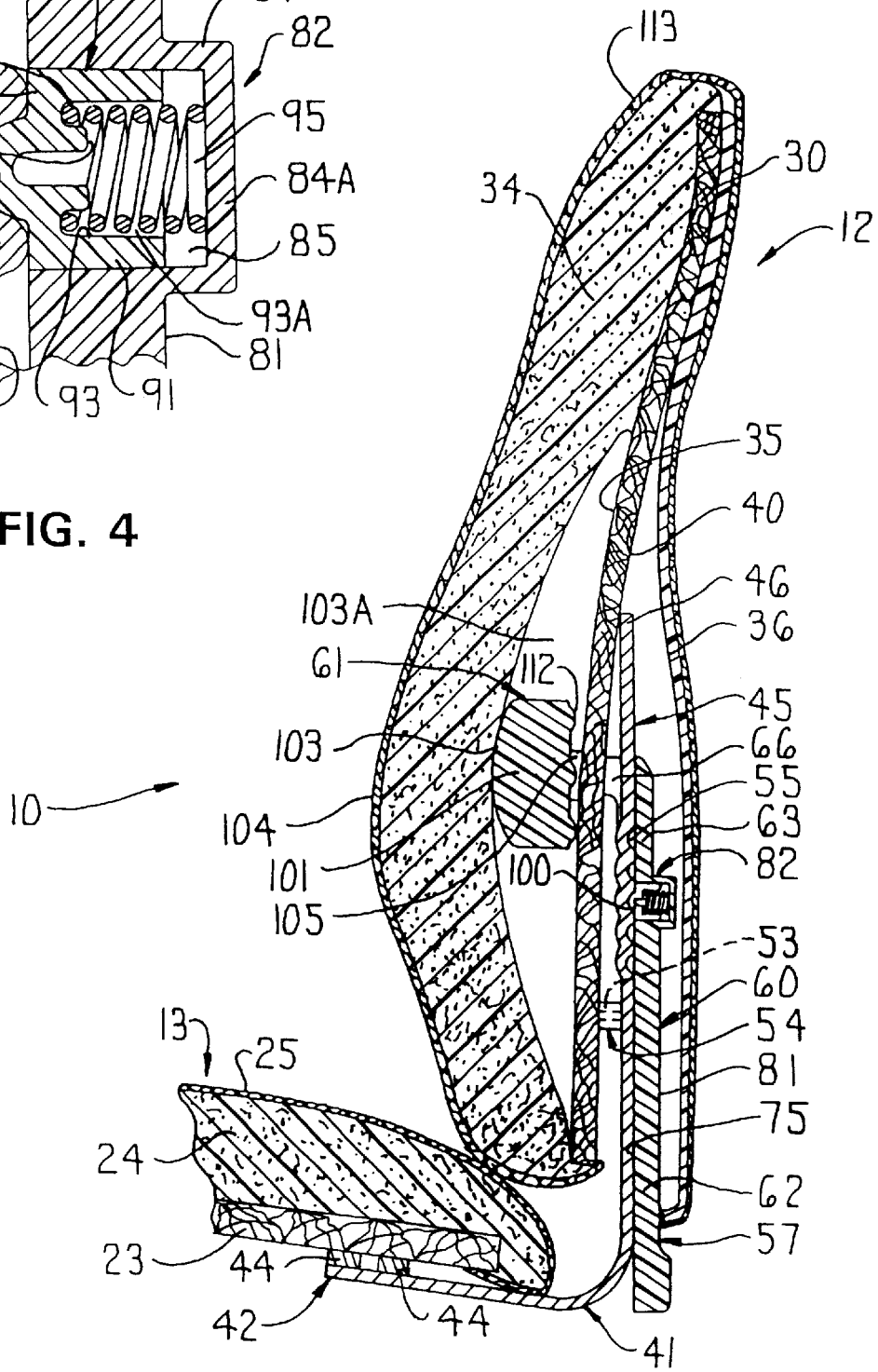
FIG. 3 is an enlarged, fragmentary, cross-sectional view taken generally along line 3–3 in FIG. 2.

The seat assembly 13, as shown in FIG. 3, includes a lower rigid structural support or seat pan 23 which is typically constructed of laminated wood, plastic or steel. A cushion 24, preferably made of resilient foam or other elastomeric material, is secured to the top of the seat pan 23 and provides a resiliently deformable seat surface. The seat pan 23 and the cushion 24 are typically covered by an outer upholstery layer 25 such as fabric, leather or vinyl.

Figure 2:
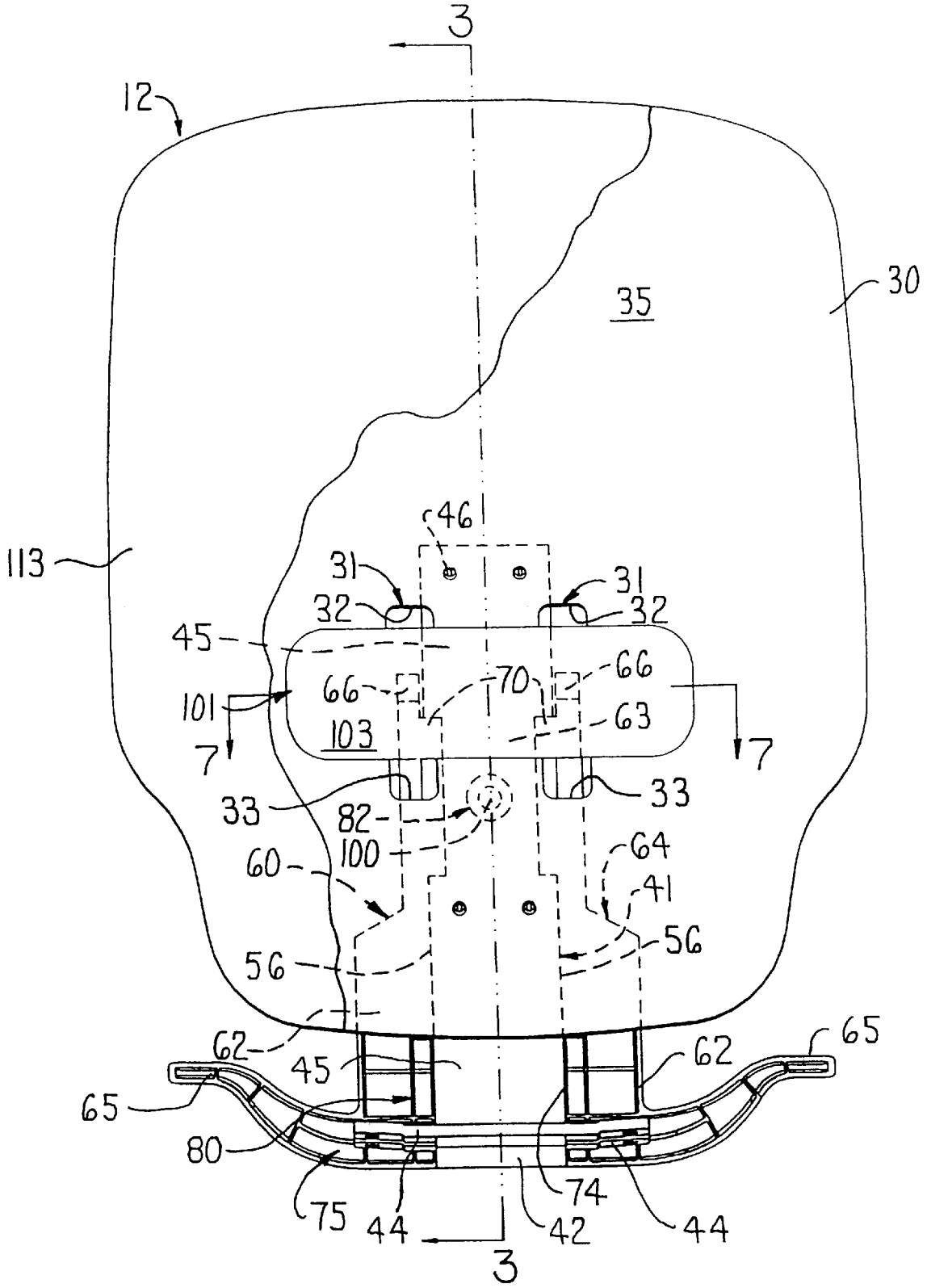
FIG. 2 is an enlarged, fragmentary, elevational front view of the backrest of FIG. 1 with a portion of the backrest cut-away to illustrate the location of the lumbar member.

The back assembly 12 is embodied by a relatively rigid inner back shell or pan 30 which has a shallow arcuate configuration so as to support the back of a user. Similar to seat pan 23, the back pan 30 is typically constructed of laminated wood, plastic or steel. As shown in FIG. 2, a pair of vertically elongate and generally parallel slots 31 are defined in back pan 30. The upper edges 32 of the slots 31 are located approximately midway along the vertical extent of back pan 30, and the lower edges 33 are spaced upwardly from the lowermost edge of back pan 30 by a distance slightly greater than the total vertical extent of slots 31. A back cushion 34 similar to cushion 24 is secured to a front face 35 of the back pan 30 to provide a resiliently deformable back surface for the user. Further, a shroud 36, such as a plastic panel, encloses a rear face 40 of the back pan 30.

As shown in FIG. 3, the back assembly 12 is mounted to the seat assembly 13 by an elongate and generally J-shaped upright or bracket 41, preferably constructed of a rigid material such as steel or an equivalent material. The upright 41 includes a generally horizontal lower leg 42 which mounts thereon a pair of elongate brackets 44 which receive fasteners (not shown) to attach the upright 41 to the underside of the seat pan 23. Alternately, the leg 42 can connect to a conventional chair control mounted under the seat. A generally vertical leg 45 is cantilevered upwardly from a rear portion of lower leg 42 adjacent the rear face 40 of back support 30. The uppermost end 46 of leg 45 is fixed to the back support 30 via a pair of fasteners or connectors (not shown) which project forwardly through holes 51 (FIG. 5) defined in upright 41 and into threaded sleeves or T-nuts (not shown) anchored within back support 30 and aligned with the respective holes 51. The lower end of leg 45 is fixed to back support 30 via fasteners 53 (shown in dotted lines in FIG. 3) which extend forwardly through holes (not shown) in leg 45, into corresponding spacers 54 mounted on and projecting generally horizontally from the rear surface 40 of back support 30, and finally into threaded sleeves or T-nuts anchored in back support 30.

Figure 4:
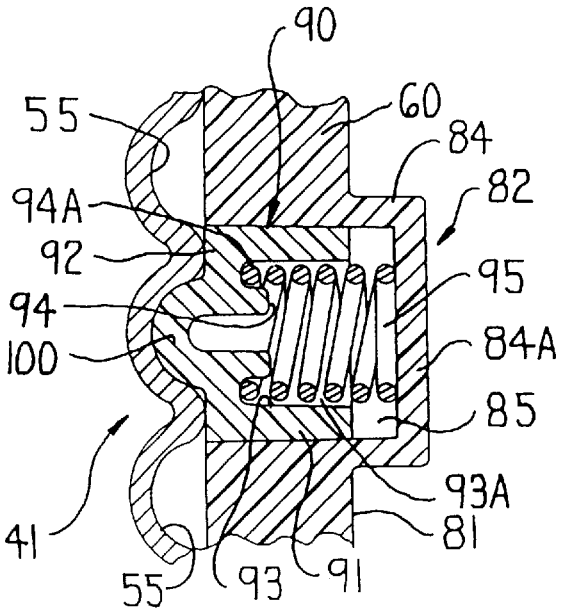
FIG. 4 is an enlarged, fragmentary, cross-sectional view of the detent mechanism of FIG. 3.

With reference to FIGS. 3 and 4, the upright 41 defines therein a plurality of generally hemispherical recesses or notches 55 which are arranged in a vertical row approximately midway between the two upright parallel end edges 56 thereof (FIG. 2). The recesses 55 open rearwardly and face the shroud 36. In the illustrated embodiment, five recesses 55 are provided, although a greater or lesser number may be desirable or necessary.

Figure 5:
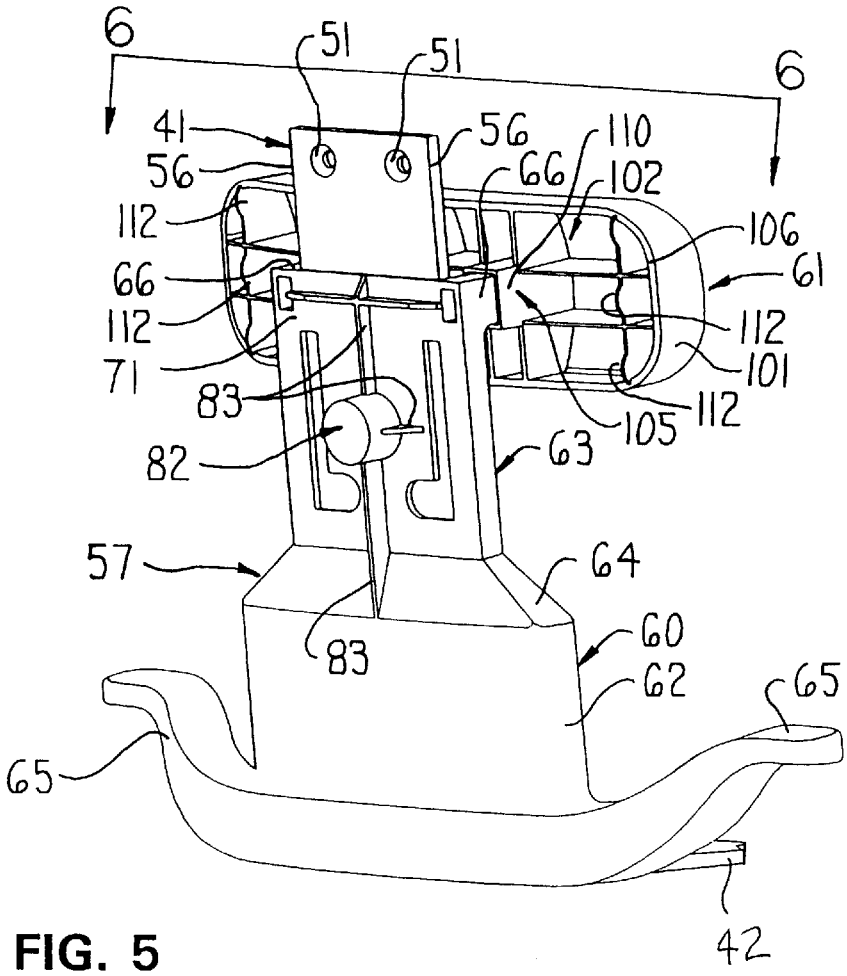
FIG. 5 is an enlarged, elevational rear view in perspective of the spine and slide assembly in isolation.

The back assembly 12 also includes a slide arrangement 57 which is mounted on the upright 41 for slidable displacement relative thereto along a generally vertical axis. As shown in FIG. 3, slide arrangement 57 is sandwiched between upright 41 and shroud 36. Slide arrangement 57 includes a slide or main body 60 having a generally inverted T-shaped configuration, and a lumbar member 61. Referring to FIG. 5, the slide 60 has a base part 62 and an extension 63 which projects upwardly from an upper wedge-shaped end 64 of base part 62. The lower end of base part 62 projects generally downwardly beyond the back pan 30 and mounts thereon a pair of handles 65 which project generally sidewardly from opposite sides of base part 62. In the illustrated embodiment, the handles 65 are formed integrally with the slide 60, and slide 60 may be constructed of rigid, yet somewhat flexible plastic, for example, via injection molding.

It will be appreciated that the illustrated handles 65 are only one type of handle which may be provided on main body 60, and other types of handles or actuators may be utilized. For example, the sidewardly projecting handles 65 may be replaced with a single handle which projects downwardly from base part 62, or a handle may be mounted at the upper end of base part 62 or elsewhere on slide arrangement 57.

Figure 6:
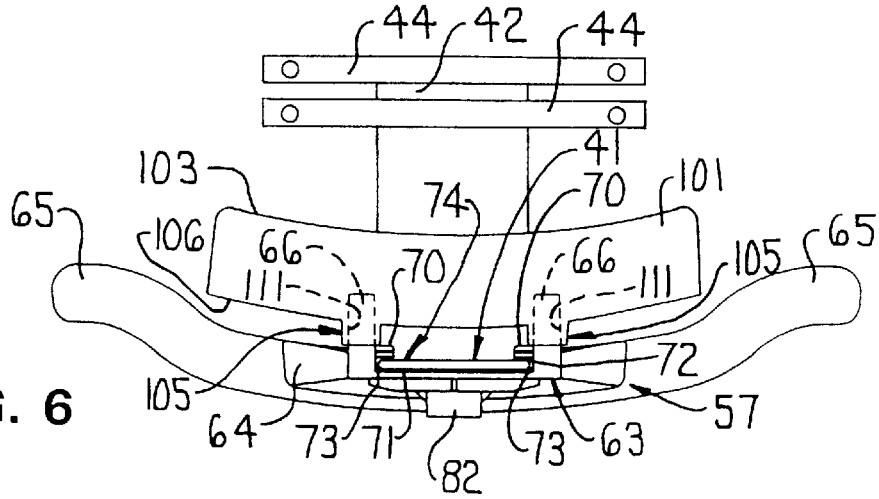
FIG. 6 is an enlarged plan view as seen generally along line 6–6 in FIG. 5.
Figure 7:
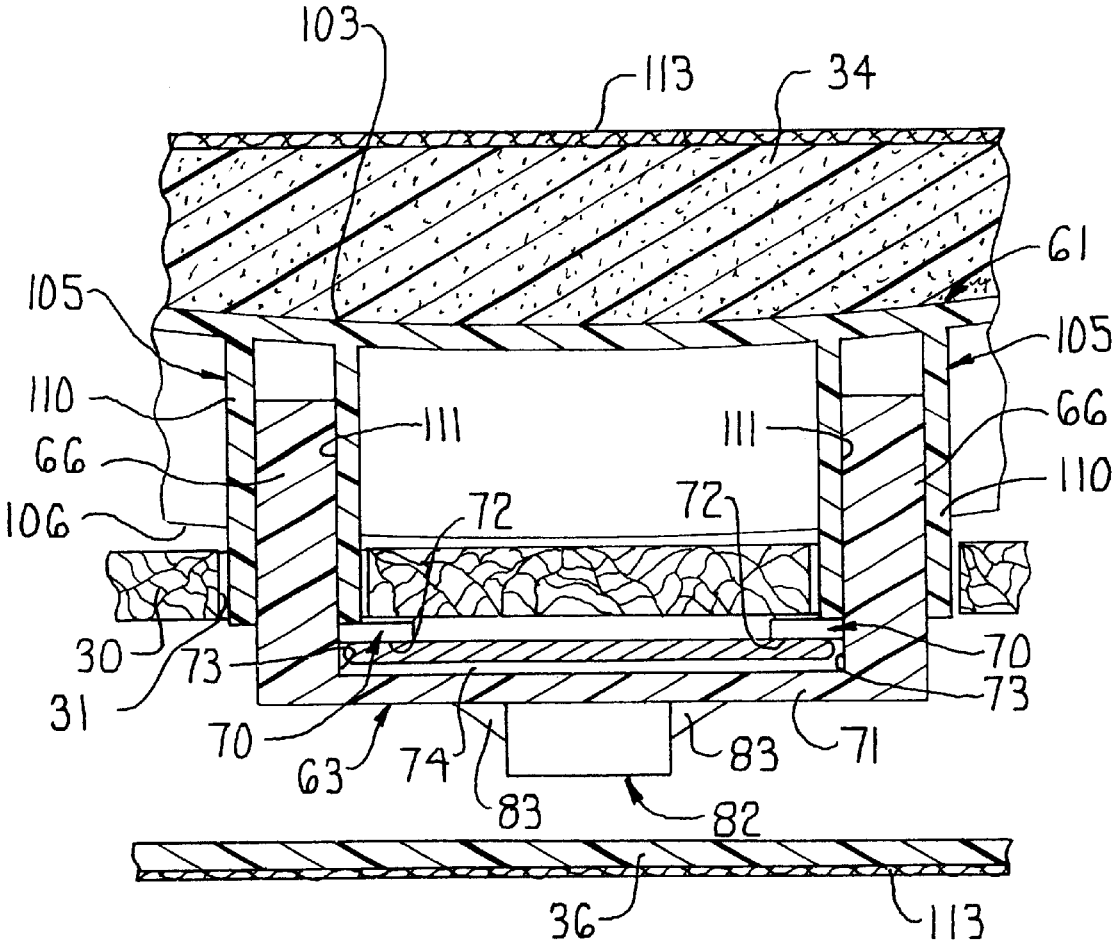
FIG. 7 is an enlarged, fragmentary sectional view taken generally along line 7–7 in FIG. 2.

As shown in FIGS. 3 and 6, the upper end of extension 63 mounts thereon a pair of mounting arms or lugs 66 which are horizontally forwardly cantilevered from extension 63. In the illustrated embodiment, the lugs 66 are parallel and sidewardly horizontally spaced from one another to provide extension 63 with a forked configuration. Extension 63 also defines thereon a pair of generally flat flanges or guides 70 which are positioned slightly beneath the respective lugs 66 and project inwardly towards one another. The flanges 70 are disposed in a common vertical plane which is horizontally 5 spaced from a rear wall 71 of extension 63 such that the inner side of rear wall 71, the inwardly facing surfaces 72 of the respective flanges 70, and the inner surfaces 73 of the respective arms 66 together define the upper extent of an elongate, generally vertically extending and sidewardly-opening channel 74 (FIG. 6). As shown in FIG. 2, the inner or front side 75 of slide 60 which faces back pan 30 is defined by a grid-like reinforcing rib structure 80 which is formed integrally with slide 60.

A knob or boss 82 projects generally horizontally outwardly from an outer or rearward side 81 of slide 60, and is located approximately midway along the vertical extent of extension 63. In the illustrated embodiment, a plurality of reinforcing ribs 83 (FIG. 5) are secured to the sides of boss 82 and extension 63. As shown in FIG. 4, boss 82 includes a generally cylindrical wall 84 and a planar end or base wall 84A which together define a hollow cylindrical interior 85 which opens forwardly of the slide 60. The axis of recess 85 extends in perpendicular and intersecting relation to the substantially planar rear surface of the upper leg 45 of upright 41. A detent element 90, such as a cup-shaped plunger or cap, is disposed within the interior 85 of boss 82. Plunger 90 is defined by a generally cylindrical outer wall 91 which slides on wall 84 and which defines an end wall 92. The inner surfaces 93 and 94 of the respective walls 91 and 92 together define a hollow interior 93A. The inner surface 94 of side wall 92 defines a ring-like recess 94A which forms part of interior 93A. As shown in FIG. 4, a spring member 95, such as a conventional compression-type coil spring, is disposed within interior 93A. One end of spring member 95 seats within recess 94A, and the opposite end bears against base wall 84A of boss 82 to bias plunger 90 outwardly (i.e. forwardly) toward the upright 41. A generally rounded or hemispherical nose 100 projects outwardly from side wall 92 for engagement with a selected one of the recesses 55 of upright 41, as discussed below. In the illustrated embodiment, the detent element 90 may be constructed of rigid plastic or metal.

Turning now to lumbar member 61, and with reference to FIGS. 5 and 6, same includes a generally horizontally elongate body member 101 which has a shallow arcuate configuration so as to conform to the natural curve of the back of the user. Body member 101, in the illustrated embodiment, is constructed of a rigid yet somewhat flexible plastic material and incorporates therein an integrally formed rib structure 102 on the rear side thereof, and a smooth nose or front face 103 having a generally convex shape (when viewed in transverse cross-section). The front face 103 bears against and displaces the cushion 34 away from the back support 30 to define a cavity 103A which provides a corresponding convex contour 104 in the cushion 34 (FIG. 3). A pair of box-like hollow projections 105 form part of the rib structure 102 opposite front face 103, and project horizontally rearwardly slightly outwardly beyond the rear edge 106 of body member 101 as shown in FIG. 6. The projections 105 are sidewardly spaced from one another and are each defined by a generally rectangular outer wall 110 which defines a generally rectangular and sidewardly opening recess 111.

In the illustrated embodiment, a vertical row of generally arcuate projections 112 are provided on opposite sides of body member 101, outwardly of the respective hollow projections 105. The arcuate projections 112 form bearing surfaces which engage the front face 35 of the back pan 30 during movement of the lumbar member 61 relative thereto, as discussed below.

As best shown in FIGS. 3 and 5, the slide 60 is positioned along the rear side of upright 41, with the respective lugs 66 thereof projecting horizontally through the correspondingly located slots 31 of back pan 30, and with the detent nose 100 engaged within one of the recesses 55 of upright 41 via the biasing force of spring member 95. The leg 45 nests within the elongate channel 74 between the respective lugs 66. The leg 45 of upright 41 is disposed behind flanges 70 of slide 60 which serve as guides during vertical movement of slide 60 as discussed below. The lumbar member 61 is attached to the extension 63 of slide 60 simply by sliding the lugs 66 into the corresponding recesses 111 of lumbar member 61. The connection between the lumbar member 61 and the slide 60 is a non-locking connection, and thus requires no fasteners. In this regard, the lumbar member 61 and the slide 60 are held in position relative to one another via an outer layer of fabric or upholstery 113 which fits tightly over and covers substantially the entire back cushion 34 which in turn retains the lumbar member 61 slidably engaged on the lugs 66.

In operation, the height of the lumbar member 61 is adjusted simply by applying an upwardly or downwardly directed force to one or both of the handles 65, which causes the nose 100 to displace rearwardly against the biasing force of spring member 95 and dislodge from the respective recess 55 of upright 41. Once the detent element 90 is aligned with the adjacent upper or lower recess 55, then the spring 95 urges same forwardly to engage the nose 100 within the selected recess 55. This upward or downward adjustment of the lumbar member 61 within the cavity 103A is effective for positioning the convex contour 104 of the back cushion 34 so as to correspond with the lumbar region of the user.

The perpendicular arrangement of the nose 100 relative to the upright 41 and the recesses 55 defined therein provides uniformity between the upward actuation force and the downward actuation force when adjusting the vertical position of the lumbar member 61, which advantageously avoids the necessity for a larger actuation force in one direction of movement as is typically the case with detent mechanisms which operate via a cantilevered spring. More specifically, the biasing force of spring 95 and the sliding movement of plunger 90 are oriented along a direction which is perpendicular to the elongated direction or rear planar surface of leg 45 of upright 41 which tends to equalize the actuation forces and provide a more consistent "feel" when adjusting the lumbar in either vertical direction.

Further, the non-positive or non-locking connection of the lumbar member 61 with the arms 66 of slide 60 simplifies assembly with the chair upholstery 113 maintaining these components in engagement with one another, and also permitting some side-to-side play or rocking of the lumbar member which can aid in user comfort.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A chair comprising:

a base;

a support arrangement mounted on said base and including a generally vertically oriented back assembly and a generally horizontally oriented seat assembly, said back assembly including a relatively rigid back support member positioned interiorly of the back assembly;

a bracket interconnecting said back and seat assemblies, said bracket having an upper elongated portion which extends generally centrally along at least part of a rear side of said back support member and defines therein a plurality of recesses arranged in a vertical row therealong;

a slide assembly mounted for generally vertical sliding movement along said bracket, said slide assembly mounting thereon a handle, an arm which projects forwardly through an opening defined in said back support member, and a lumbar structure slidably supported on a free terminal end of said arm and positioned adjacent a front side of said back support member for providing support to the lumbar region of the back of the user; and a plunger mounted on said slide assembly and defining an outwardly protruding nose thereon, said plunger being slidably and linearly movable relative to said bracket in a direction perpendicular to the elongated direction of said upper portion thereof, and said plunger being biased toward said bracket whereby when said handle is manipulated by a user, said nose engages within a selected one of said recesses to adjust the vertical height of said lumbar structure along said back support member.

2. The chair of claim 1 including a resilient cushion attached to part of said front side of said back support member, said lumbar structure having a generally convex front surface which engages a rear side of said cushion, said lumbar structure being disposed between said cushion and said back support member for sliding movement therebetween so as to horizontally displace a portion of said cushion and define a corresponding convex contour therein.

3. The chair of claim 1 wherein said recesses each have a generally hemispherical concave shape and said nose has a generally convex hemispherical shape such that said nose slides smoothly between said recesses during vertical adjustment of said lumbar structure.

4. The chair of claim 1 wherein said slide assembly defines thereon a generally hollow and sidewardly opening boss which confines said plunger therein, and a spring is disposed within said boss to urge said plunger toward said bracket to engage said nose in a selected one of said recesses.

5. The chair of claim 4 wherein said bracket is sandwiched between said slide assembly and said support member with said recesses of said bracket opening sidewardly to face said slide assembly for selective engagement with said nose.

6. The chair of claim 1 wherein said arm is mounted an upper end portion of said slide assembly, said lumbar structure being slidably movable along said front side of said back support member, and said slide assembly defining therein an elongate and generally vertically extending channel within which said upper portion of said bracket is slidably disposed.

7. The chair of claim 6 wherein said slide assembly has a lower end portion which defines thereon said handle said handle projecting downwardly beyond a lower edge of said back assembly so as to be accessible by a seated user.

8. A chair comprising:

a support arrangement including a back assembly and a seat assembly and a rigid structural element interconnecting said assemblies to one another, said back assembly including a rigid back pan for supporting the back of a user and including an outer cover which extends over at least a front side of said back assembly; and a mechanism for adjusting the contour of said back assembly to suit the user, said mechanism comprising a generally horizontally elongate lumbar support for supporting the lumbar region of the back of the user and a generally upright body member, said body member defining thereon an arm which is cantilevered outwardly therefrom and which slidably seats thereon said lumbar support to position said lumbar support at said front side of said back pan, and a handle which when actuated by a user slides said body member relative to said structural element to adjust the vertical height of said lumbar support, said cover being snugly engaged over said back assembly such that said cover maintains said lumbar support and said body member in engagement with one another without the need for a positive connection therebetween.

9. The chair of claim 8 wherein said lumbar support defines therein a recess in which a free terminal end of said arm is non-positively engaged, said engagement of said free end of said arm within said recess and said snug engagement of said cover on said back assembly together constituting the sole fastening of said lumbar support and body member to one another.

10. The chair of claim 8 wherein said lumbar support defines a front side having a generally convex configuration and a rear side defining therein a recess for receiving a terminal free end of said arm.

11. The chair of claim 8 wherein said body member has an upper portion which defines a pair of said arms thereon, said arms being generally parallel to one another and transversely oriented relative to a lower portion of said body member, said arms having respective terminal free ends on which said lumbar support is seated, said back pan defining therein a pair of vertically oriented and elongate slots through which the respective said arms project to position said lumbar support adjacent said front side of said back pan.

12. The chair of claim 11 wherein the cover includes a resilient cushion attached adjacent said front side of said back pan, said lumbar support being disposed between said cushion and said back pan and being slidably vertically adjustable therealong to horizontally displace part of said cushion and define a corresponding convex contour thereon for supporting the lumbar region of the back of the user.

13. The chair of claim 11 wherein said lumbar support has a front side facing said cover and a rear side facing said back pan, said rear side defining therein a pair of recesses within which the terminal free ends of the respective said arms seat to removably and non-positively mount said lumbar support on said body member.

14. The chair of claim 8 wherein said structural element is generally J-shaped and has a lower leg fixed to said seat assembly and an upper leg fixed to said back pan, said body member having a rear wall and defining a generally vertically oriented channel extending along said rear wall within which said upper leg is disposed, said body member further including a pair of guides which are horizontally spaced from said rear wall and disposed on opposite sides of said channel, said guides projecting inwardly toward one another to confine said upper leg within said channel during sliding movement of said body member relative to said upper leg.

15. The chair of claim 14 wherein said body member defines a pair of said arms on an upper portion thereof which are sidewardly spaced from one another and disposed on opposite sides of said channel adjacent the respective said guides, said arms being generally parallel to one another and transversely oriented relative to a lower portion of said body member, said back pan defining therein a pair of vertically elongate slots through which the respective said arms project to position said lumbar support adjacent said front side of said back pan.

16. A chair comprising:

a base;

a generally vertically oriented back support and a generally horizontally oriented seat support positioned on said base, said back support incorporating therein a rigid back member defining an opening therein;

a rigid structural element having a first portion connected to said back member and a second portion connected to said seat support;

an adjustable lumbar arrangement associated with said back support, said arrangement including a lumbar support, a slide element disposed adjacent a rear side of said back member and vertically slidably movable relative thereto, and a connector which projects through said opening of said back member and has a terminal end slidably received in a recess defined within said lumbar support so as to interconnect said lumbar support and said slide element and position said lumbar support adjacent a front side of said back member, said slide element having a handle connected thereto for adjusting the vertical height of said lumbar support; and a detent mechanism cooperating between said structural and slide elements for adjusting the vertical location of said lumbar support to suit the contour of the user's back, said detent mechanism including a reciprocating detent part and a biasing member each supported on one said element and a plurality of notches arranged in a generally vertical row along the other said element, said biasing member exerting a force on said detent part to urge same into engagement with a selected one of said notches.

17. The chair of claim 16 wherein said connector is mounted on an upper end of said slide element and is cantilevered outwardly therefrom, said recesses therein which slidably receive respective said terminal ends and said chair includes a cover which tightly envelopes said back support and maintains said slide element and said lumbar support in engagement with one another.

18. The chair of claim 17 wherein said slide element mounts a pair of said connectors on said upper end thereof which are horizontally spaced from one another to provide said upper end with a forked configuration, and said lumbar support defines a pair of said recesses therein which slidably receive respective said terminal ends of said connectors, and said back member defines therein a pair of said openings through which said connectors respectively extend, said openings having a generally vertically elongated configuration to allow vertical movement of said connectors relative to said back member during height adjustment of said lumbar support.

19. The chair of claim 16 wherein said detent part is supported for linear reciprocating movement within a recess defined in said slide element and said notches are defined in said structural element along an elongated and linear portion thereof, said detent part defining thereon a nose having a generally hemispherical shape, and said force of said biasing member is oriented along a direction which is perpendicular to said linear portion of said structural element.

20. The chair of claim 16 wherein said structural element is sandwiched between said back member and said slide element, said chair includes a resilient cushion attached at said front side of said back member, and said lumbar support is disposed between said cushion and said back member such that the lumbar support horizontally displaces said cushion to create a convex contour therein.

* * * * *

UNITED STATES PATENT AND TRADEMARK OFFICE

CERTIFICATE OF CORRECTION

PATENT NO. : 6,419,318 B1
DATED : July 16, 2002
INVENTOR(S) : Scott Albright

It is certified that error appears in the above-identified patent and that said Letters Patent is hereby corrected as shown below:

Column 8,
Lines 56-57, delete "said recesses therein which slidably receive respective said terminal ends".

Signed and Sealed this

Twenty-fourth Day of December, 2002

JAMES E. ROGAN
*Director of the United States Patent and Trademark Office*